US011523684B1

(12) United States Patent
Huang

(10) Patent No.: US 11,523,684 B1
(45) Date of Patent: Dec. 13, 2022

(54) HOLDER FOR CONSUMER ELECTRONIC DEVICE

(71) Applicant: Cheng Yu Huang, New Taipei (TW)

(72) Inventor: Cheng Yu Huang, New Taipei (TW)

( * ) Notice: Subject to any disclaimer, the term of this patent is extended or adjusted under 35 U.S.C. 154(b) by 0 days.

(21) Appl. No.: 17/485,700

(22) Filed: Sep. 27, 2021

(51) Int. Cl.
*A47B 23/04* (2006.01)
*A47B 23/06* (2006.01)
*A47B 97/00* (2006.01)

(52) U.S. Cl.
CPC ..... *A47B 23/043* (2013.01); *A47B 23/04* (2013.01); *A47B 23/042* (2013.01); *A47B 23/044* (2013.01); *A47B 23/06* (2013.01); *A47B 2023/049* (2013.01); *A47B 2097/006* (2013.01)

(58) Field of Classification Search
CPC ..... A47B 23/043; A47B 23/042; A47B 2023/049; A47B 23/04; A47B 23/044; A47B 2097/006; A47B 23/06
See application file for complete search history.

(56) References Cited

U.S. PATENT DOCUMENTS 1,074,430 A * 9/1913 Hill ..... A47B 23/042 211/195
3,417,954 A * 12/1968 Croninger ..... A47B 23/044 D19/91
5,433,415 A * 7/1995 Samson ..... A47B 23/06 248/448
7,384,020 B2 * 6/2008 Hsu ..... A47B 23/043 248/146
8,020,818 B2 * 9/2011 Chou ..... F16M 13/00 248/176.1
8,534,619 B2 * 9/2013 Huang ..... F16M 13/00 248/463
9,010,701 B1 * 4/2015 Cooper ..... G10G 5/00 84/327
9,625,081 B2 * 4/2017 Olander ..... A47B 97/08
9,894,988 B2 * 2/2018 Olander ..... F16M 11/10
2009/0072113 A1 * 3/2009 To ..... B42F 13/402 248/464

(Continued)

FOREIGN PATENT DOCUMENTS

GB 2126886 A * 4/1984 ..... A47B 23/043
KR 200440212 Y1 * 5/2008 ..... A47B 23/043

(Continued)

*Primary Examiner* — Jonathan Liu
*Assistant Examiner* — Taylor Morris
(74) *Attorney, Agent, or Firm* — Demian K. Jackson; Jackson IPG PLLC

(57) ABSTRACT

A holder includes first and second support surfaces, first and second bases, pivotal first and second legs, and a folding linking assembly. Front ends of the first and second support surfaces are pivotably secured to front ends of the first and second base respectively; each of the first and second support surfaces include a transverse groove in a central portion, a recess below a bottom, a lengthwise trough in a rear portion of a top, and a limit member moveably disposed in the first trough; each of the first and second bases include parallel first slits on a rear portion of a top; each of the first and second legs have an upper end pivotably secured to the bottom of the first or second support surface; and the folding linking assembly is pivotably disposed between the front ends of the first and second support surfaces.

3 Claims, 18 Drawing Sheets

(56) References Cited

U.S. PATENT DOCUMENTS

| | | | | |
|---|---|---|---|---|
| 2009/0114790 | A1* | 5/2009 | Fan | F16M 11/38 248/346.5 |
| 2010/0078928 | A1* | 4/2010 | Mercieca | B42D 9/00 281/42 |
| 2014/0060393 | A1* | 3/2014 | Fan | F16M 11/14 108/3 |
| 2015/0103057 | A1* | 4/2015 | Lei | F16M 13/00 345/179 |
| 2015/0115125 | A1* | 4/2015 | Hou | A47B 23/043 248/454 |
| 2015/0276121 | A1* | 10/2015 | Max | F16M 11/38 248/462 |
| 2015/0374118 | A1* | 12/2015 | van Hooft | A45C 11/00 248/451 |
| 2016/0286953 | A1* | 10/2016 | Castro | A47B 23/04 |
| 2021/0059402 | A1* | 3/2021 | Huang | F16M 11/2021 |
| 2021/0330075 | A1* | 10/2021 | Gulick | A47B 23/04 |

FOREIGN PATENT DOCUMENTS

| | | | | | |
|---|---|---|---|---|---|
| KR | 20120006360 | U | * | 9/2012 | A47B 23/043 |
| KR | 101293836 | B1 | * | 8/2013 | A47B 23/00 |
| KR | 101475762 | B1 | * | 12/2014 | F16M 11/10 |
| KR | 20200079089 | A | * | 7/2020 | G06F 1/166 |
| WO | WO-2012134136 | A2 | * | 10/2012 | A47B 23/043 |

* cited by examiner

HOLDER FOR CONSUMER ELECTRONIC DEVICE

BACKGROUND OF THE INVENTION

1. Field of the Invention

The invention relates to holders and more particularly to a holder for holding one or more consumer electronic devices (e.g., a notebook computer, a tablet computer, a mobile phone, or two mobile phones).

2. Description of Related Art

Consumer electronic devices such as computers, tablet computers, mobile communication devices, etc. are characterized by similar specifications and short shelf life.

Nowadays, mobile phones, tablet computers, notebook computers, etc. have the functions of communication, camera, AV playing, accessing the Internet, storage, etc.

A wide variety of holders for consumer electronic devices such as computers, tablet computers, mobile communication devices, etc. are commercially available. However, they are disadvantageous due to limited applications, bulkiness, inconvenience in use, etc. Thus, the need for improvement still exists.

SUMMARY OF THE INVENTION

It is therefore one object of the invention to provide a holding device comprising a first support surface, a second support surface, a first base, a second base, a pivotal first leg, a pivotal second leg, and a folding linking assembly wherein the first support surface is parallel to the second support surface, a front end of the first support surface is pivotably secured to a front end of the first base, and a front end of the second support surface is pivotably secured to a front end of the second base; the first support surface includes a transverse first groove in a central portion, a first recess below a bottom, a lengthwise first trough in a rear portion of a top, and a first limit member moveably disposed in the first trough; the second support surface includes a transverse second groove in a central portion, a second recess below a bottom, a lengthwise second trough in a rear portion of a top, and a second limit member moveably disposed in the second trough; the first base includes a plurality of parallel first slits on a rear portion of a top; the second base includes a plurality of parallel second slits on a rear portion of a top; the first leg has an upper end pivotably secured to the bottom of the first support surface proximate the first groove; the second leg has an upper end pivotably secured to the bottom of the second support surface proximate the first groove; in a ready to use state a lower end of the first leg is positioned in one of the first slits of the first base, and a lower end of the second leg is positioned in one of the first slits of the second base; the folding linking assembly includes a first bar having a first recess and one end pivotably secured to a front end of the first recess; a second bar having a second recess and one end pivotably secured to a front end of the second recess; a pin pivotably secured the other end of the first bar to the other end of the second bar; a first snapping member disposed in the first recess and having one end pivotably secured to one end of the first recess; and a second snapping member disposed in the second recess and having one end pivotably secured to one end of the second recess; in a fully extended state of the folding linking assembly, the first support surface, the folding linking assembly, and the second support surface form a U-shaped configuration; and in a fully folded state of the folding linking assembly, the folding linking assembly is received in both the first recess and the second recess and the first support surface is in proximity to the second support surface.

The above and other objects, features and advantages of the invention will become apparent from the following detailed description taken with the accompanying drawings.

DETAILED DESCRIPTION OF THE INVENTION

Figure 1:
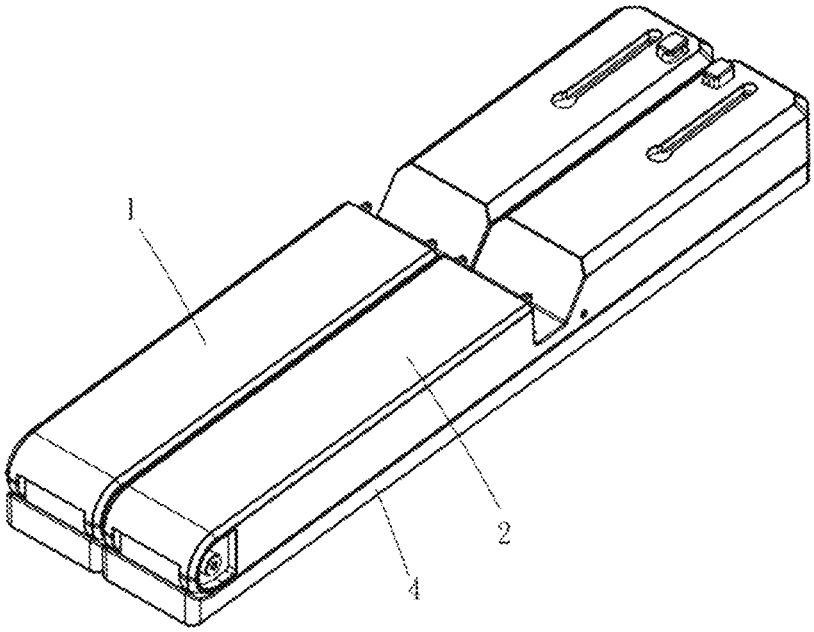
FIG. 1 is a perspective view of a holder according to the invention.
Figure 2:
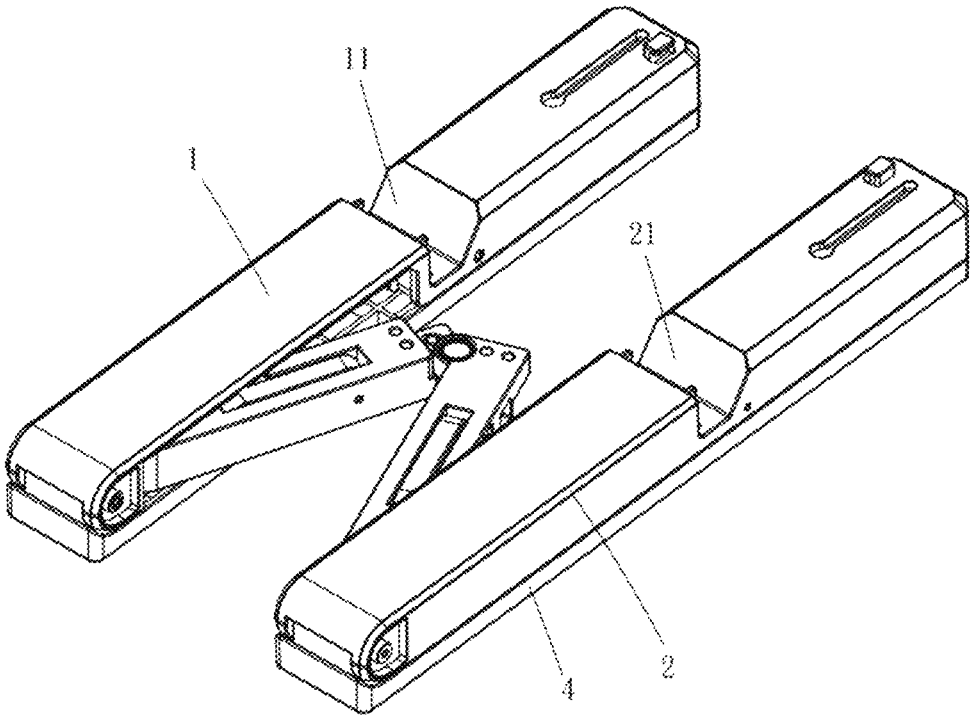
FIG. 2 is a perspective view of the holder in a half extended position.
Figure 3:
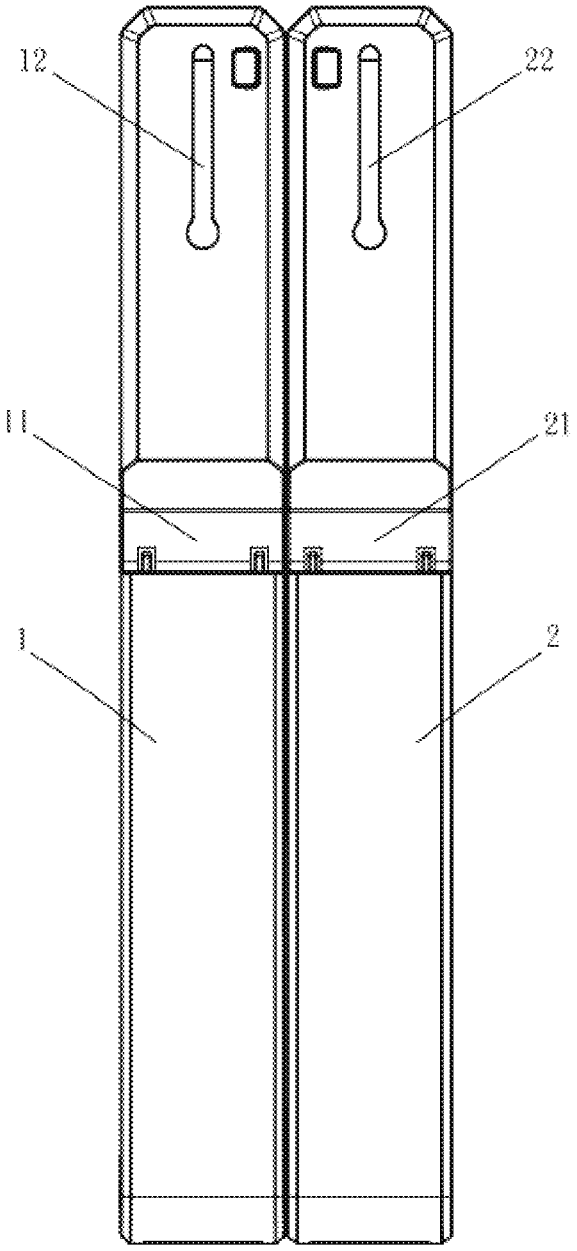
FIG. 3 is a top view of the holder of FIG. 1.
Figure 4:
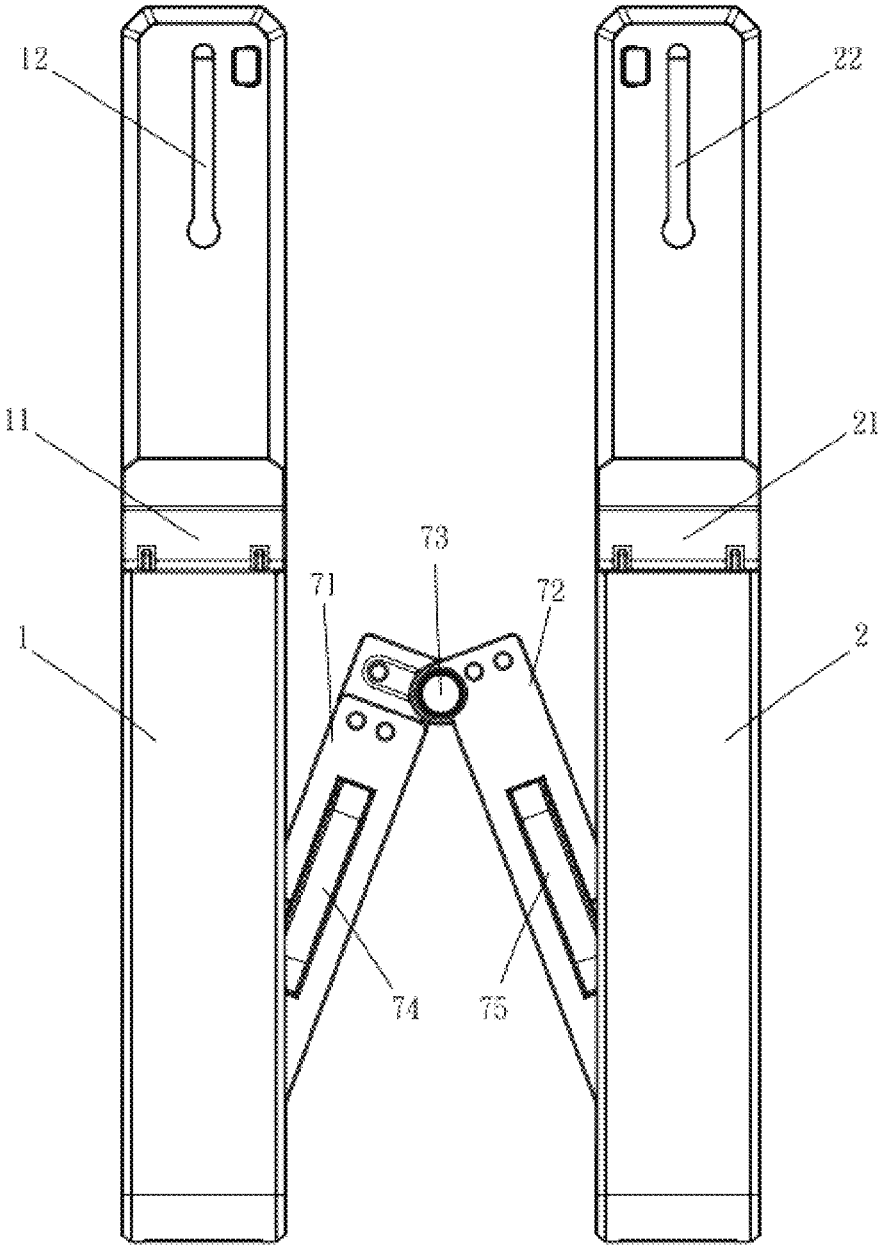
FIG. 4 is a top view of the holder of FIG. 2.
Figure 5:
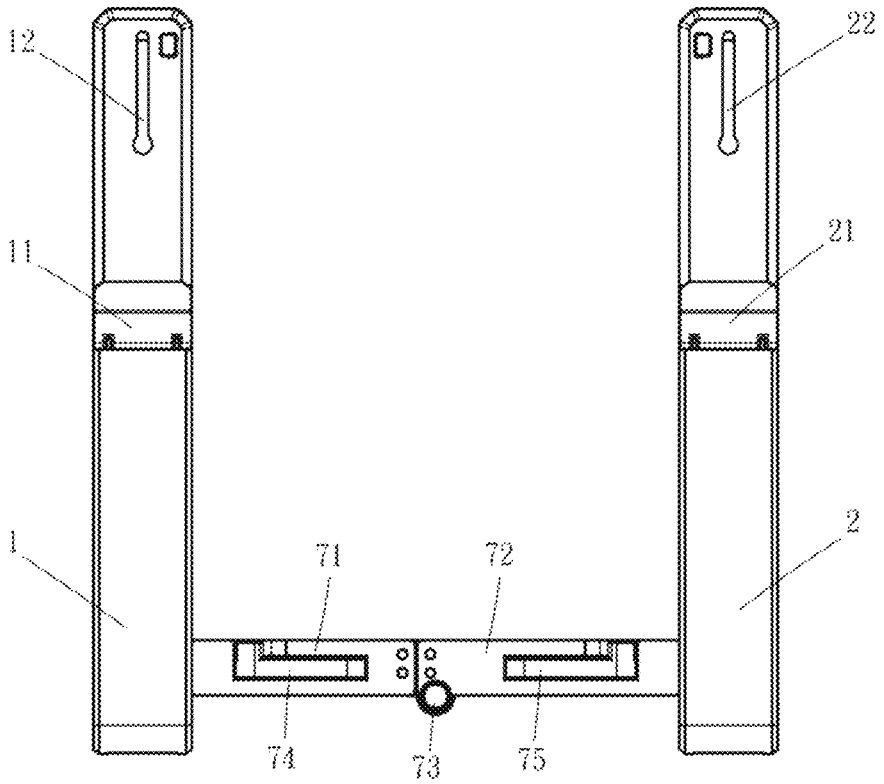
FIG. 5 a top view of the fully extended holder.
Figure 6:
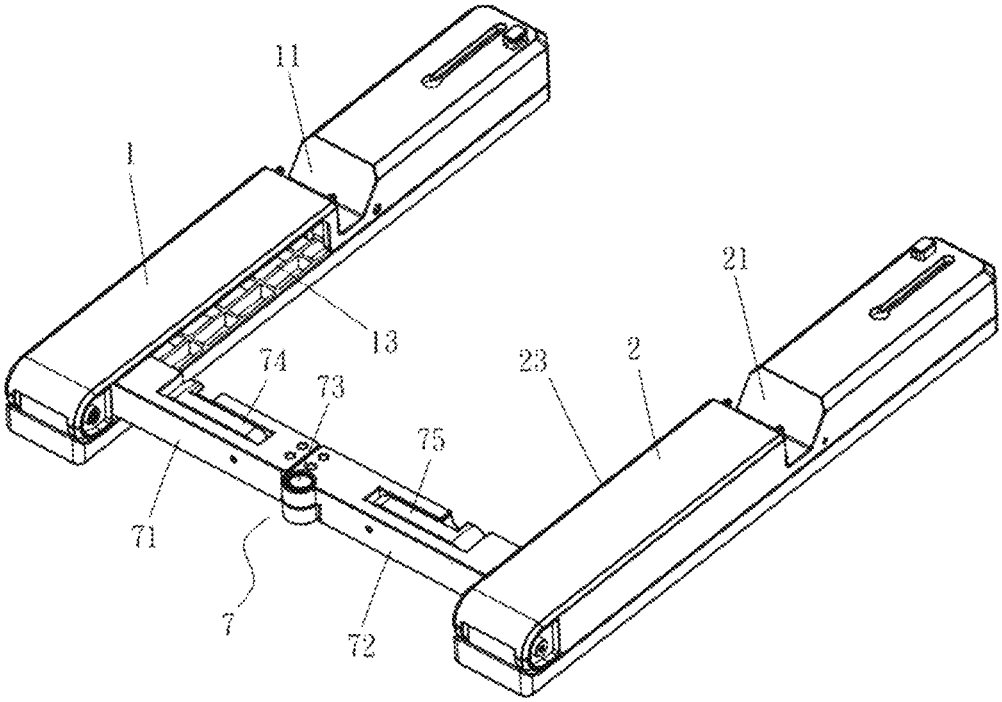
FIG. 6 is a perspective view of FIG. 5.
Figure 7:
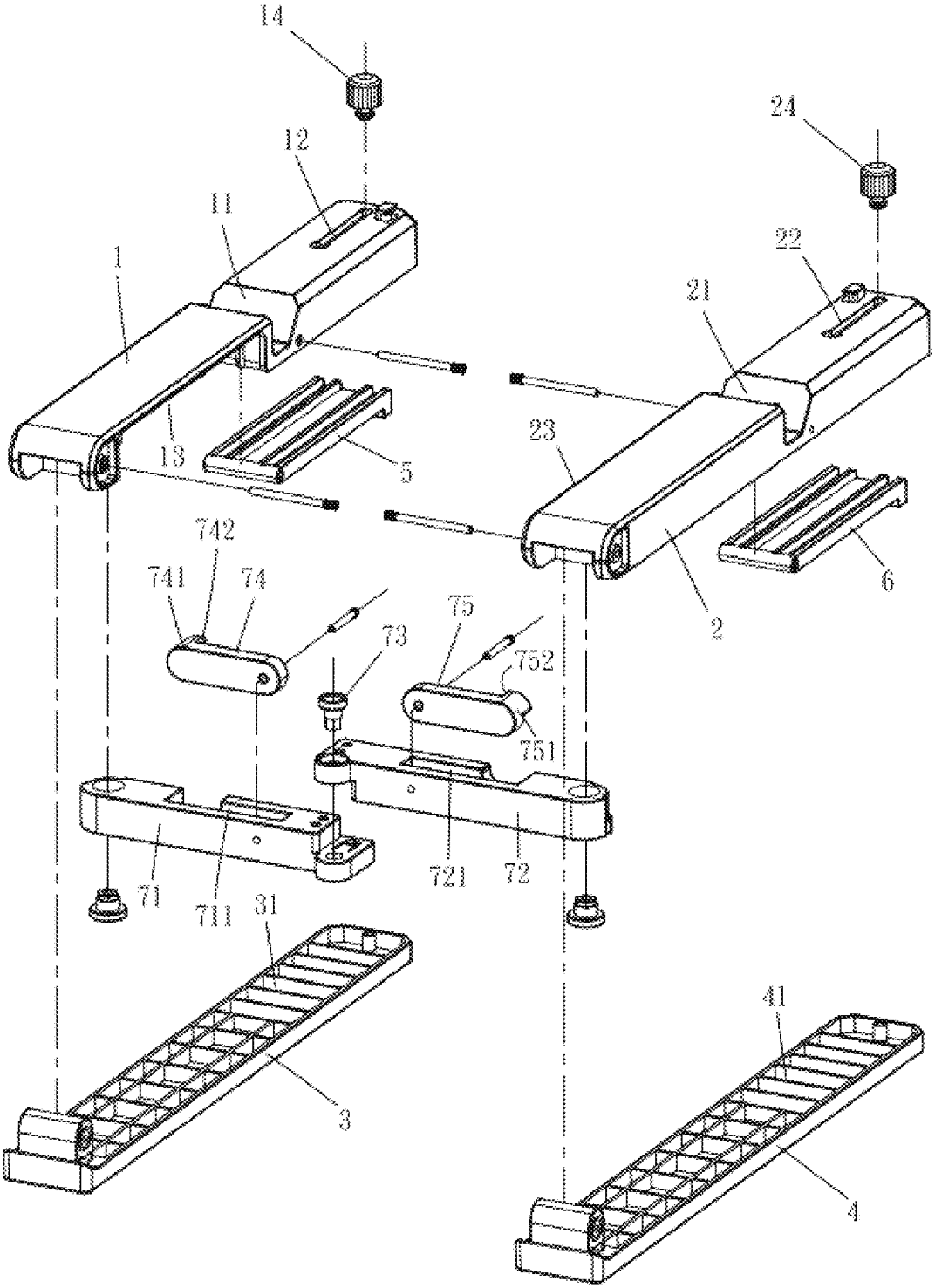
FIG. 7 is an exploded view of the holder.
Figure 8:
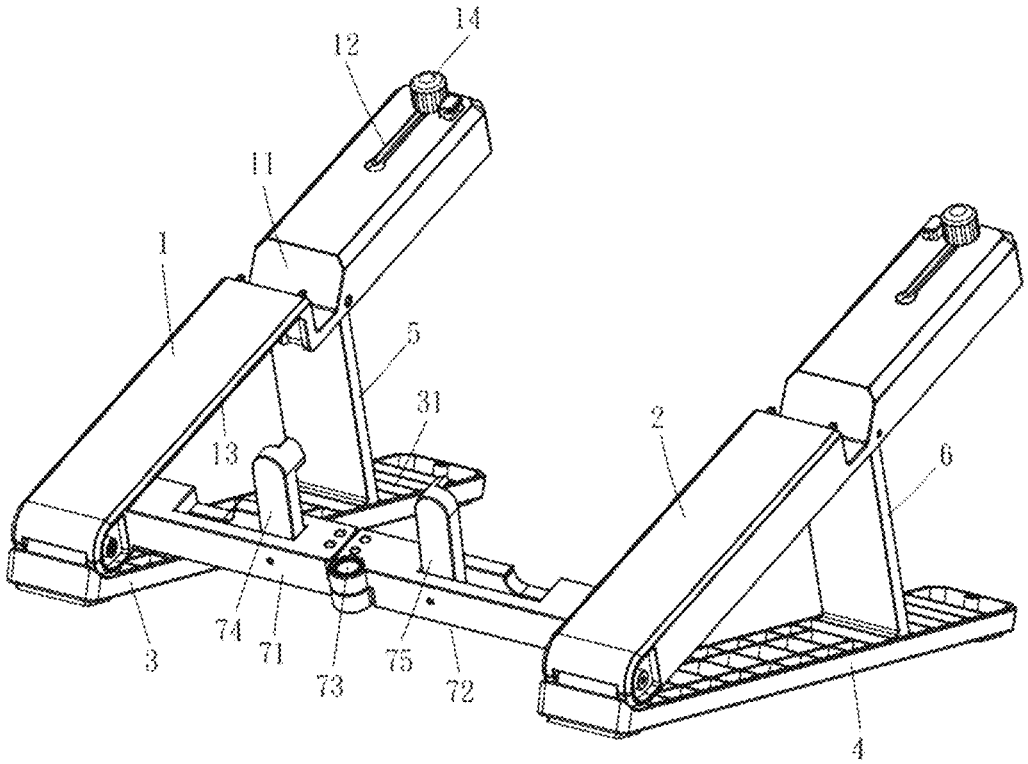
FIG. 8 is a perspective view of the holder with the support surfaces being inclined by positioning lower ends of the pivotal first and second legs in the slits of the first and second bases respectively in a ready to use state.
Figure 9:
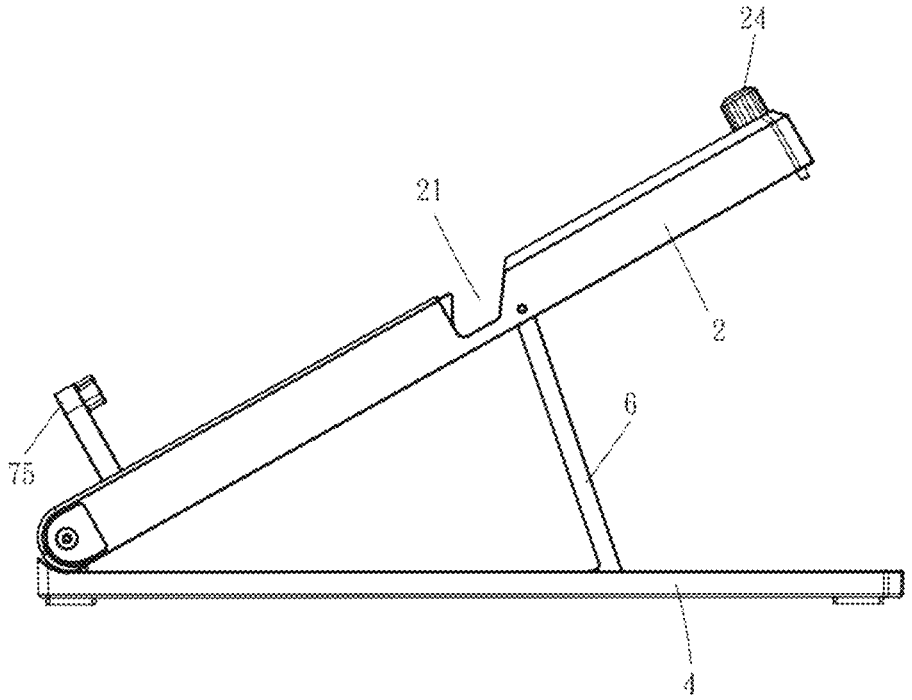
FIG. 9 is a side elevation of FIG. 8.

Referring to FIGS. 1 to 9, a holder for consumer electronic device in accordance with the invention comprises a first support surface 1, a second support surface 2, a first base 3, a second base 4, a pivotal first leg 5, a pivotal second leg 6, and a folding linking assembly 7 as discussed in detail below.

The first support surface 1 is parallel to the second support surface 2. A front end of the first support surface 1 is pivotably secured to a front end of the first base 3, and a front end of the second support surface 2 is pivotably secured to a front end of the second base 4. A transverse first groove 11 having an inclined rear end is provided in a central portion of the first support surface 1 and a transverse second groove 21 having an inclined rear end is provided in a central portion of the second support surface 2. A first recess 13 is provided below a bottom of the first support surface 1 and a second recess 23 is provided below a bottom of the second support surface 2. A lengthwise first trough 12 is provided in a rear portion of a top of the first support surface 1 and a lengthwise second trough 22 is provided in a rear portion of a top of the second support surface 2. A first limit member 14 is moveably disposed in the first trough 12 and a second limit member 24 is moveably disposed in the second trough 22. A plurality of parallel first slits 31 are provided on a rear portion of a top of the first base 3 and a plurality of parallel second slits 41 are provided on a rear portion of a top of the second base 4. An upper end of the first leg 5 is pivotably secured to the bottom of the first support surface 1 proximate the first groove 11 and an upper end of the second leg 6 is pivotably secured to the bottom of the second support surface 2 proximate the second groove 21. In a ready to use state a lower end of the first leg 5 is positioned in one of the first slits 31 of the first base 3 and a lower end of the second leg 6 is positioned in one of the first slits 41 of the second base 4. Thus, the first leg 5 is at an inclined angle with respect to the first base 3 and the second leg 6 is at the same inclined angle with respect to the second base 4. The folding linking assembly 7 includes a first bar 71 having a first recess 711 and one end pivotably secured to a front end of the first recess 13; a second bar 72 having a second recess 721 and one end pivotably secured to a front end of the second recess 23; a pin 73 pivotably secured the other end of the first bar 71 to the other end of the second bar 72; a first snapping member 74 disposed in the first bar recess 711 and having one end pivotably secured to one end of the first bar recess 711, the first snapping member 74 having a first curved surface 741 at the other end, and a first clamping element 742 projecting out of the first curved surface 741; and a second snapping member 75 disposed in the second bar recess 721 and having one end pivotably secured to one end of the second recess bar 721, the second snapping member 75 having a second curved surface 751 at the other end, and a second clamping element 752 projecting out of the second curved surface 751. In a fully extended state of the folding linking assembly 7 (see FIG. 5), the first support surface 1, the folding linking assembly 7 and the second support surface 2 form a U. In a fully folded state of the folding linking assembly 7 (see FIG. 1), the folding linking assembly 7 is received in both the first recess 13 and the second recess 14 and the first support surface 1 is in close proximity to the second support surface 2.

Figure 10:
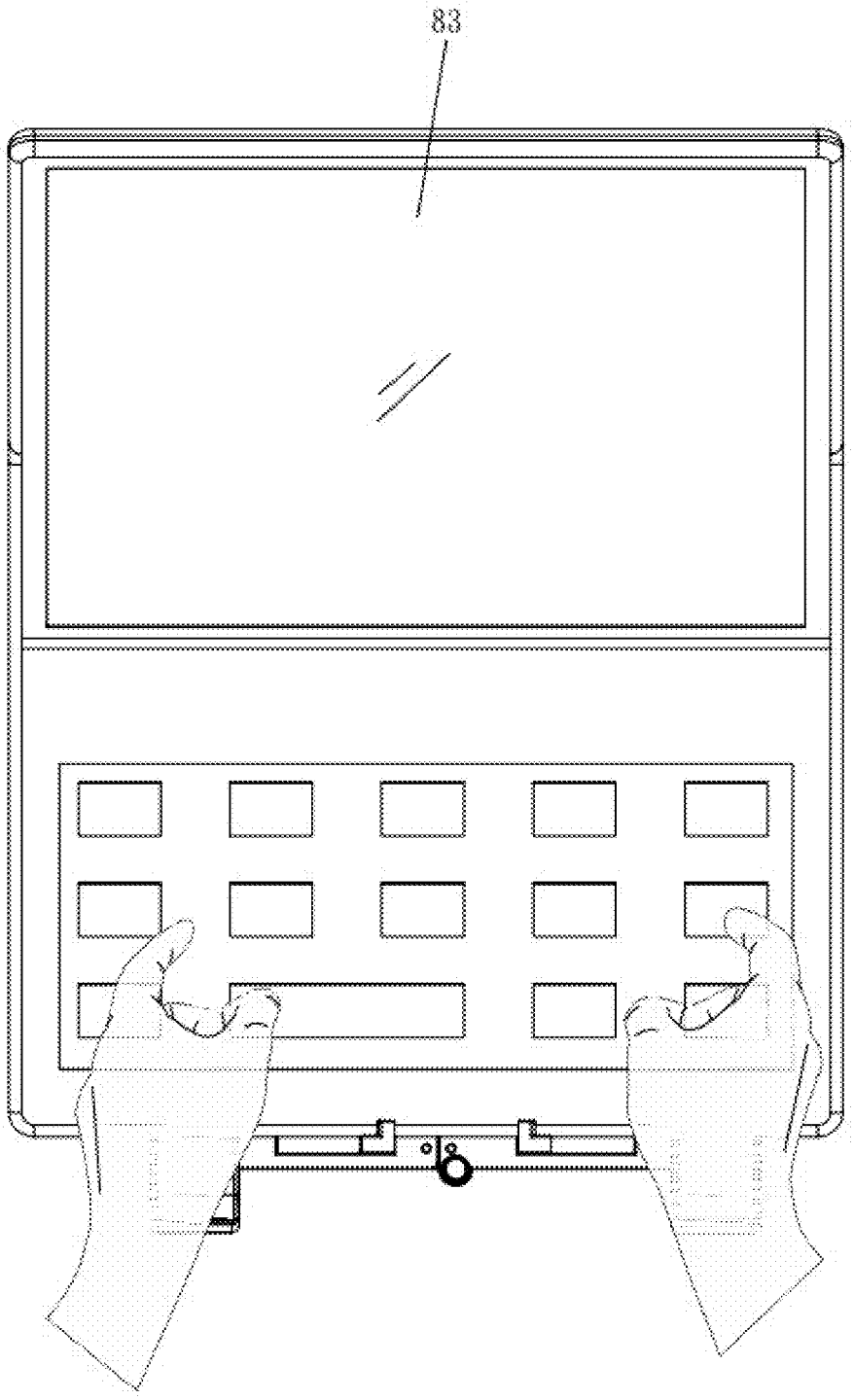
FIG. 10 is a top view showing a notebook computer put on the holder of FIG. 8 by two hands.

Referring to FIG. 10 in conjunction with FIGS. 1 to 9, a notebook computer 83 is put on both the first support surface 1 and the second support surface 2 of the fully extended folding linking assembly 7.

Figure 11:
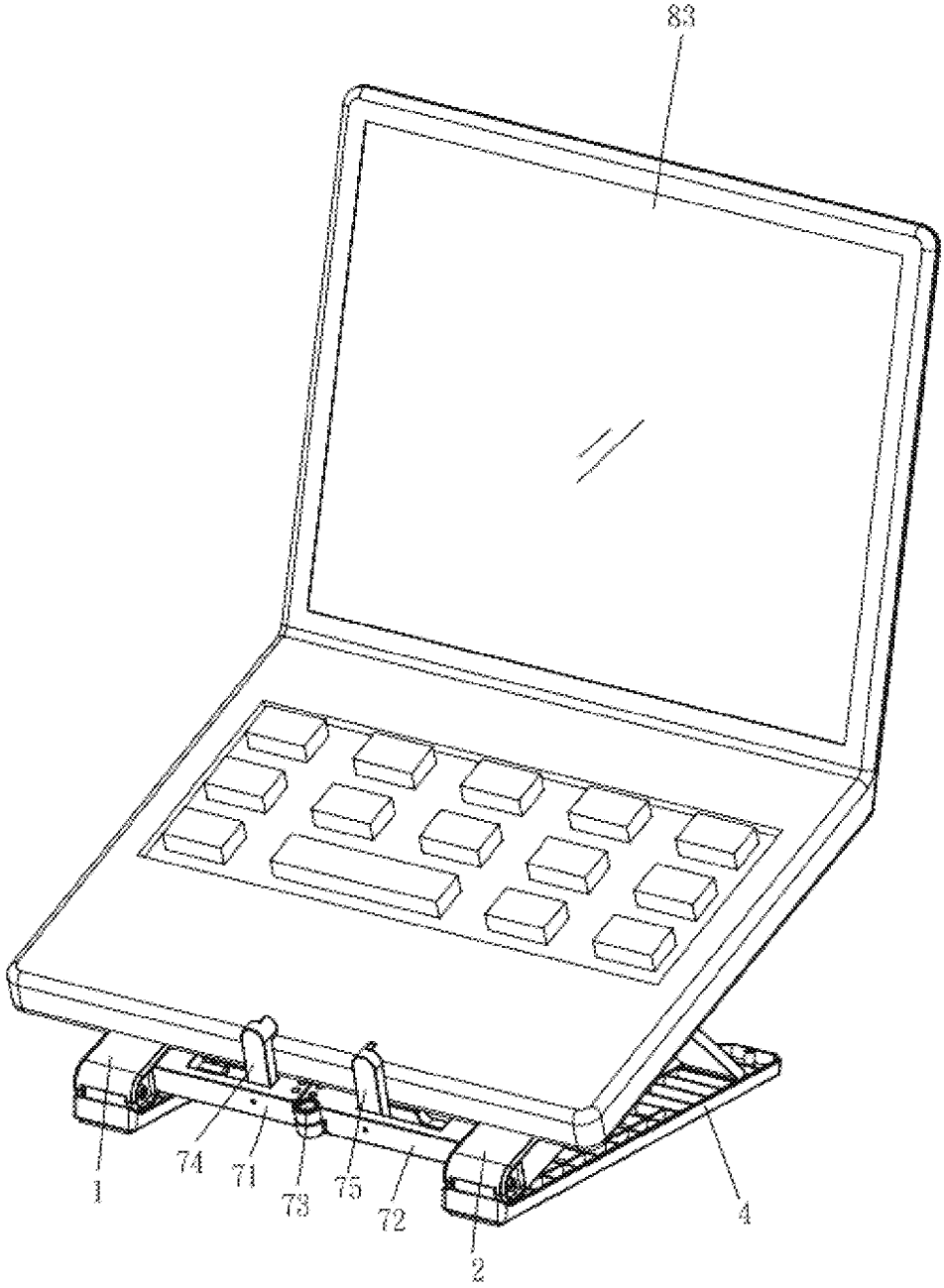
FIG. 11 is a perspective view of FIG. 10 with the hands removed.

Referring to FIGS. 10 and 11 in conjunction with FIGS. 1 to 9, a notebook computer 83 is put on both the first support surface 1 and the second support surface 2 of the fully extended folding linking assembly 7. A front end of the notebook computer 83 is fastened by the first clamping element 742 of the upright first snapping member 74 and the second clamping element 752 of the upright second snapping member 75.

Figure 12:
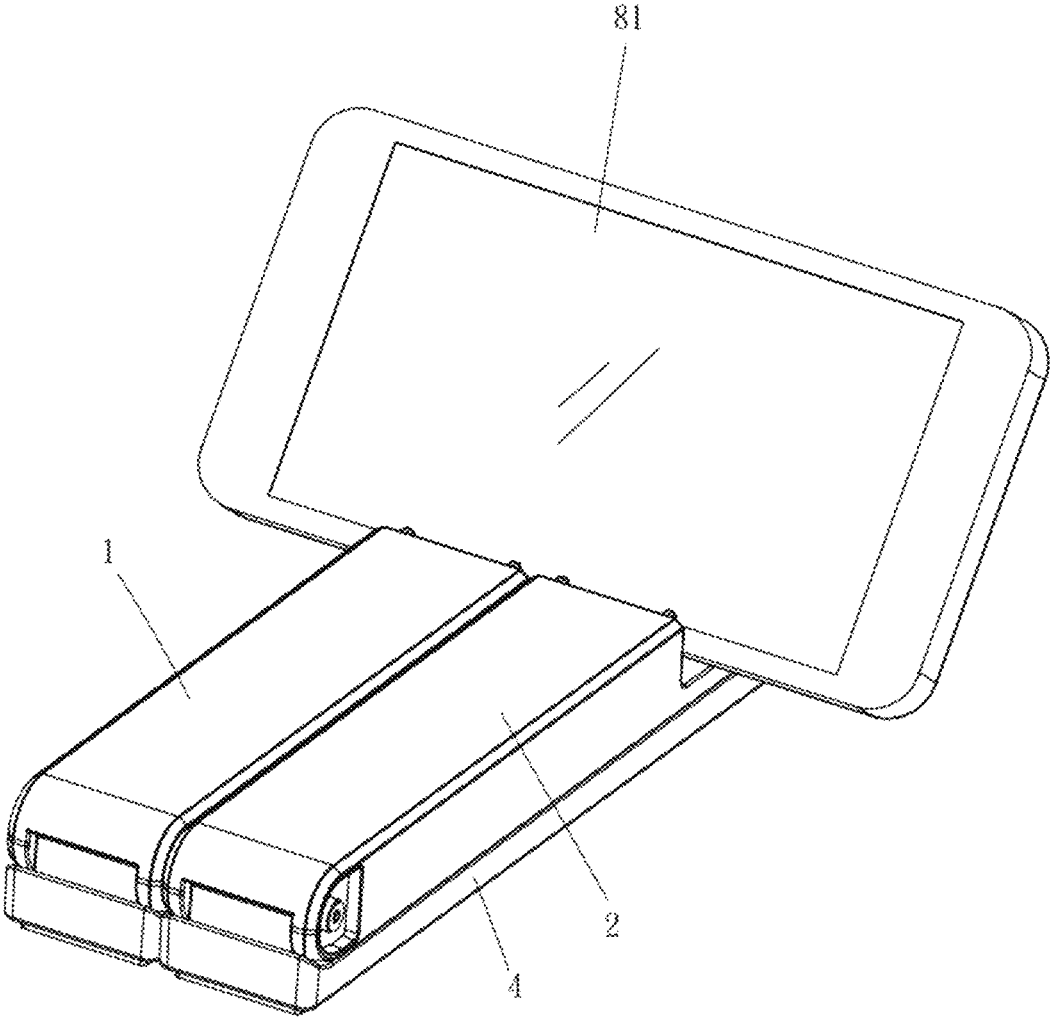
FIG. 12 is a perspective view of the holder with a mobile phone put thereon.

Referring to FIG. 12 in conjunction with FIGS. 1 to 9, a mobile phone 81 is held by the first groove 11 and the second groove 21 when the folding linking assembly 7 is fully folded.

Figure 13:
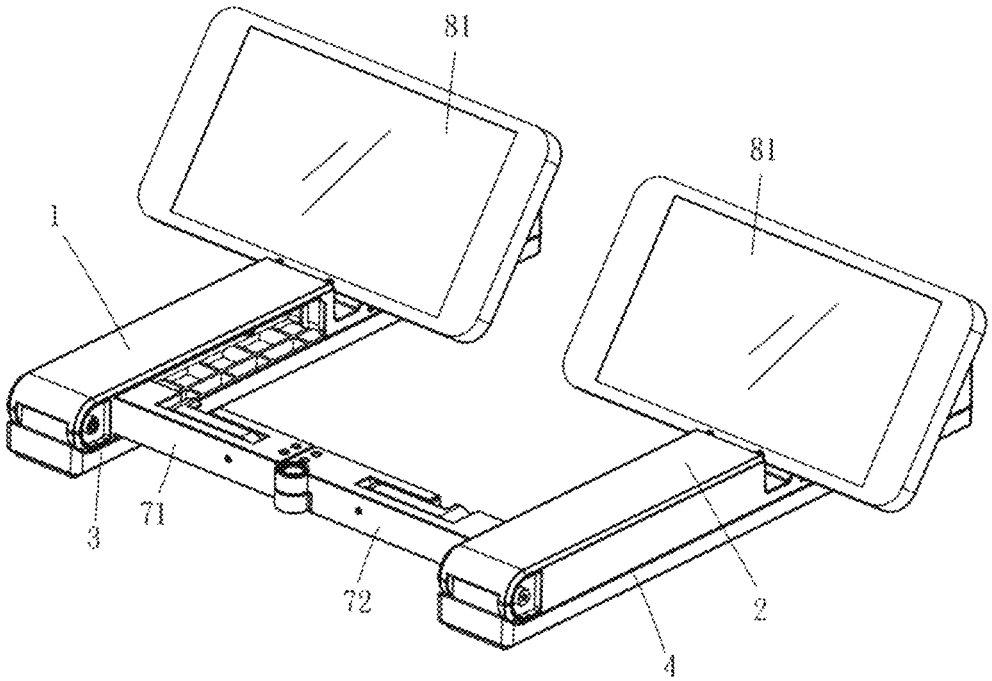
FIG. 13 is a perspective view of the holder with two mobile phones put thereon in a first embodiment.
Figure 14:
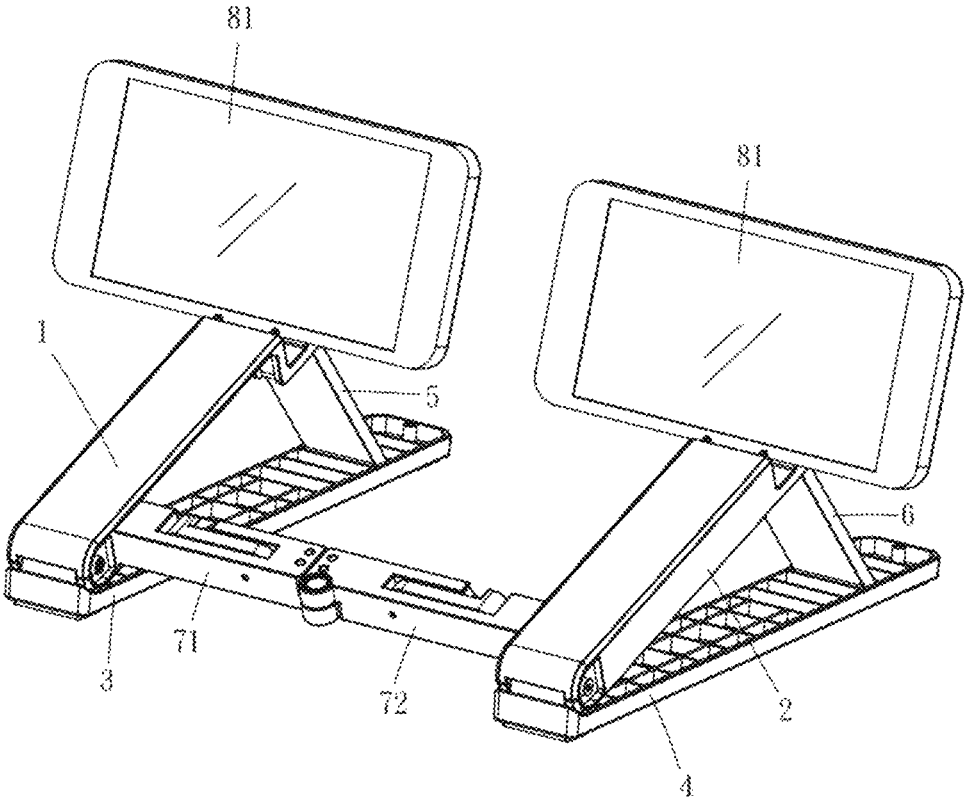
FIG. 14 is a perspective view of the holder with two mobile phones put thereon in a second embodiment.

Referring to FIGS. 13 and 14 in conjunction with FIGS. 1 to 9, one mobile phone 81 is held by the first groove 11 and the other mobile phone 81 is held by the second groove 21 when the folding linking assembly 7 is fully extended.

Figure 15:
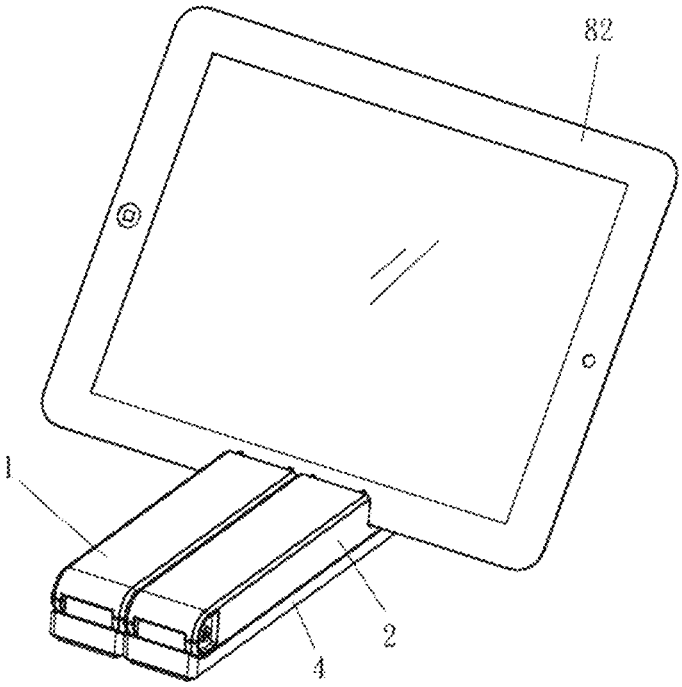
FIG. 15 is a perspective view of the holder with a tablet computer put thereon in a first configuration.

Referring to FIG. 15 in conjunction with FIGS. 1 to 9, a tablet computer 82 is held by both the first groove 11 and the second groove 21 when the folding linking assembly 7 is fully folded.

Figure 16:
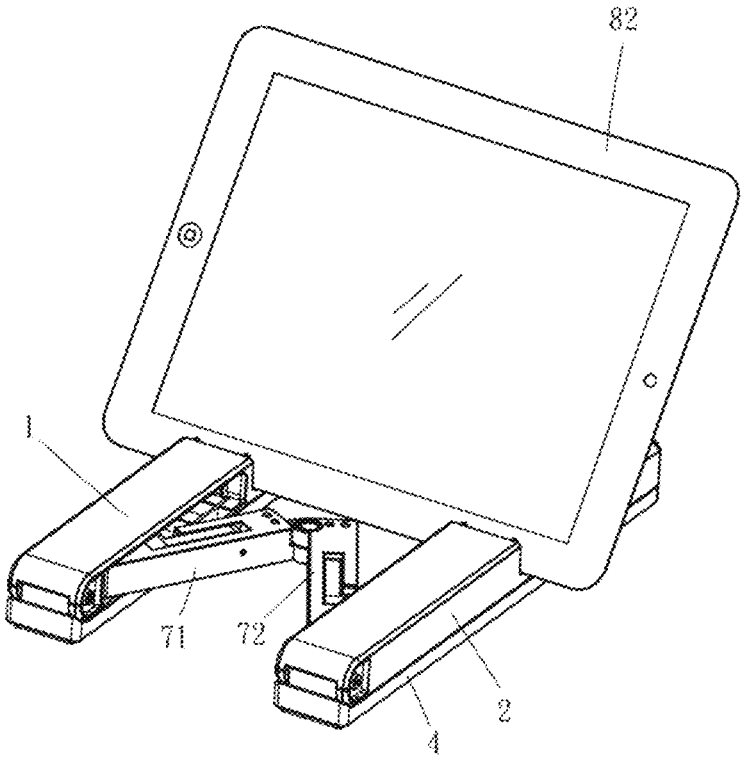
FIG. 16 is a perspective view of the holder with a tablet computer put thereon in a second configuration.

Referring to FIG. 16 in conjunction with FIGS. 1 to 9, a tablet computer 82 is held by both the first groove 11 and the second groove 21 when the folding linking assembly 7 is half extended.

Figure 17:
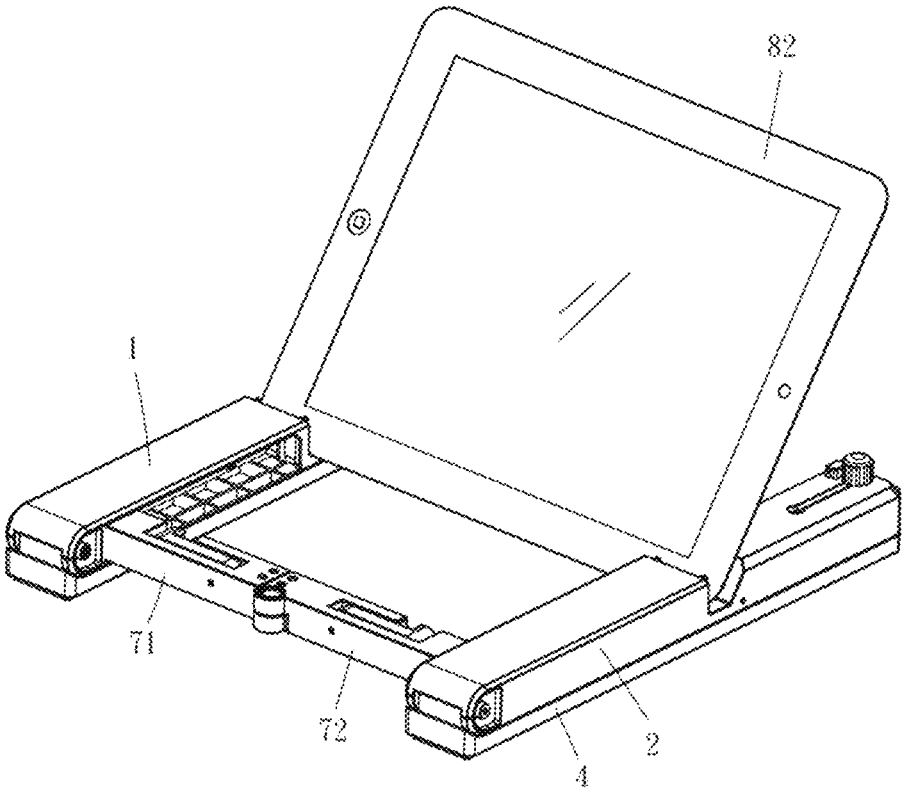
FIG. 17 is a perspective view of the holder with a tablet computer put thereon in a third configuration.

Referring to FIG. 17 in conjunction with FIGS. 1 to 9, a tablet computer 82 is held by both the first groove 11 and the second groove 21 when the folding linking assembly 7 is fully folded.

Figure 18:
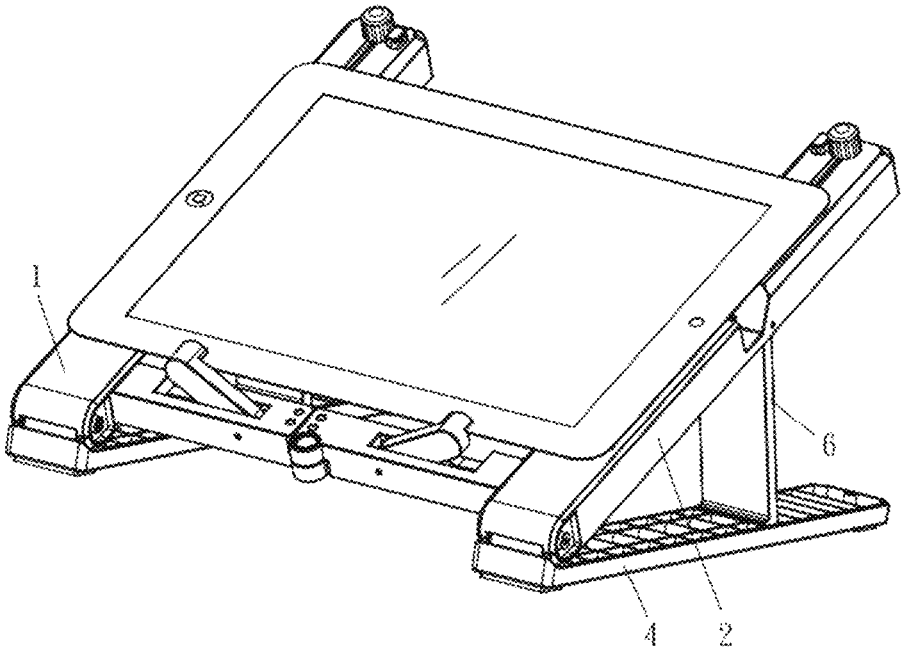
FIG. 18 is a perspective view of the holder with a tablet computer put thereon in a fourth configuration.

Referring to FIG. 18 in conjunction with FIGS. 1 to 9, a tablet computer 82 is held by both the first support surface 1 and the second support surface 2 and a front end of the tablet computer 82 is fastened by the first clamping element 742 of the inclined first snapping member 74 and the second clamping element 752 of the inclined second snapping member 75 when the folding linking assembly 7 is fully folded.

While the invention has been described in terms of preferred embodiments, those skilled in the art will recognize that the invention can be practiced with modifications within the spirit and scope of the appended claims.

What is claimed is:

1. A holding device, comprising a first support surface member (1), a second support surface member (2), a first base (3), a second base (4), a pivotal first leg (5), a pivotal second leg (6), and a folding linking assembly (7) wherein:

the first support surface member (1) is parallel to the second support surface member (2), a front end of the first support surface member (1) is pivotably secured to a front end of the first base (3), and a front end of the second support surface member (2) is pivotably secured to a front end of the second base (4);

the first support surface member (1) includes a transverse first groove (11) in a central portion, a first recess (13) below a bottom of the first support surface member (1), a lengthwise first trough (12) in a rear portion of a top portion, and a first limit member (14) moveably disposed in the first trough (12);

the second support surface member (2) includes a transverse second groove (21) in a central portion, a second recess (23) below a bottom of the second support surface member (2), a lengthwise second trough (22) in a rear portion of a top portion, and a second limit member (24) moveably disposed in the second trough (22);

the first base (3) includes a plurality of parallel first slits (31) on a rear portion of a top portion;

the second base (4) includes a plurality of parallel second slits (41) on a rear portion of a top portion;

the pivotal first leg (5) has an upper end pivotably secured to the bottom of the first support surface member (1) proximate the transverse first groove (11);

the pivotal second leg (6) has an upper end pivotably secured to the bottom of the second support surface member (2) proximate the transverse second groove (21);

in a ready to use state a lower end of the pivotal first leg (5) is positioned in one of the parallel first slits (31) of the first base (3), and a lower end of the pivotal second leg (6) is positioned in one of the parallel second slits (41) of the second base (4);

the folding linking assembly (7) includes a first bar (71) having a first bar recess (711) and one end pivotably secured to a front end of the first recess (13); a second bar (72) having a second bar recess (721) and one end pivotably secured to a front end of the second recess (23); a pin (73) pivotably secured to an other end of the first bar (71) and to an other end of the second bar (72);

a first snapping member (74) disposed in the first bar recess (711) and having one end pivotably secured to one end of the first bar recess (711); and a second snapping member (75) disposed in the second bar recess (721) and having one end pivotably secured to one end of the second bar recess (721);

in a fully extended state of the folding linking assembly (7), the first support surface member (1), the folding linking assembly (7), and the second support surface member (2) form a U-shaped configuration; and in a fully folded state of the folding linking assembly (7), the folding linking assembly (7) is received in both the first recess (13) and the second recess (14) and the first support surface member (1) is in proximity to the second support surface member (2).

2. The holding device of claim 1, wherein a rear end of the transverse first groove (11) is inclined and a rear end of the transverse second groove (21) is inclined.

3. The holding device of claim 1, wherein the first snapping member (74) includes a first curved surface (741) at an other end, and a first clamping element (742) projecting out of the first curved surface (741); and the second snapping member (75) includes a second curved surface (751) at an other end, and a second clamping element (752) projecting out of the second curved surface (751).

* * * * *